US010256014B2

(12) United States Patent
Imai et al.

(10) Patent No.: US 10,256,014 B2
(45) Date of Patent: Apr. 9, 2019

(54) WIRE-WOUND RESISTOR AND METHOD FOR MANUFACTURING SAME

(71) Applicant: KOA CORPORATION, Ina-shi, Nagano (JP)

(72) Inventors: Tomohito Imai, Ina (JP); Shun Kato, Ina (JP); Yoshihisa Nakaji, Ina (JP); Yoichi Sakai, Ina (JP)

(73) Assignee: KOA CORPORATION, Ina-shi (JP)

( * ) Notice: Subject to any disclaimer, the term of this patent is extended or adjusted under 35 U.S.C. 154(b) by 71 days.

(21) Appl. No.: 15/529,235

(22) PCT Filed: Nov. 16, 2015

(86) PCT No.: PCT/JP2015/082085
§ 371 (c)(1),
(2) Date: May 24, 2017

(87) PCT Pub. No.: WO2016/088541
PCT Pub. Date: Jun. 9, 2016

(65) Prior Publication Data

US 2017/0330656 A1 Nov. 16, 2017

(30) Foreign Application Priority Data

Dec. 5, 2014 (JP) ..... 2014-246879
Jan. 30, 2015 (JP) ..... 2015-016876

(51) Int. Cl.
*H01C 3/00* (2006.01)
*H01C 1/148* (2006.01)
*H01C 3/14* (2006.01)
(Continued)

(52) U.S. Cl.
CPC ..... *H01C 3/00* (2013.01); *H01C 1/012* (2013.01); *H01C 1/148* (2013.01); *H01C 3/14* (2013.01); *H01C 17/04* (2013.01)

(58) Field of Classification Search
CPC ..... H01C 3/00; H01C 1/012; H01C 1/148; H01C 17/04
(Continued)

(56) References Cited

U.S. PATENT DOCUMENTS 2,518,225 A * 8/1950 Dorst ..... H01C 3/02 333/23
2,628,300 A * 2/1953 Berkelhamer ..... H01C 1/032 29/620
(Continued)

FOREIGN PATENT DOCUMENTS

JP 50-82552 A 7/1975
JP 59-115501 A 7/1984
(Continued)

OTHER PUBLICATIONS 59-115501, Matsushita Electric, Jul. 4, 1984, machine translation.*
(Continued)

*Primary Examiner* — Kyung S Lee
(74) *Attorney, Agent, or Firm* — Westerman, Hattori, Daniels & Adrian, LLP

(57) ABSTRACT

To provide a wire-wound resistor provided with high reliability and that retains the basic functionality of the wire-wound resistor, and a method for manufacturing the same. A wire-wound resistor in which a resistor wire is wound onto an external periphery of a core (11) obtained by bundling fibrous insulators, and a connection terminal (13) is attached to both ends of the core (11) and connected to the resistor wire (12*a*), wherein the core (11) is impregnated with a binder in the portion (11*a*) in the vicinity of the external periphery. The binder (1) is preferably not included in a center portion (11*b*) of the core (11).

13 Claims, 6 Drawing Sheets

(51) Int. Cl.
*H01C 1/012* (2006.01)
*H01C 17/04* (2006.01)

(58) Field of Classification Search
USPC ..... 338/302
See application file for complete search history.

(56) References Cited

U.S. PATENT DOCUMENTS 3,085,316 A * 4/1963 Nelson ..... H01C 1/084
29/424
3,327,275 A * 6/1967 Kirkendall ..... H01C 3/00
336/205
3,792,406 A * 2/1974 Kreifels ..... H01C 1/036
337/160
4,039,995 A * 8/1977 Walton ..... H01C 3/16
219/548
7,174,701 B2 * 2/2007 Horn ..... H01C 3/20
57/12

FOREIGN PATENT DOCUMENTS

JP 64-53501 A 3/1989
JP 9-320804 A 12/1997
JP 2000-150212 A 5/2000

OTHER PUBLICATIONS

JP 64-053501, Deguchi, Mar. 1, 1989, machine translation.*
International Search Report dated Feb. 23, 2016, issued in counterpart International Application No. PCT/JP2015/082085 (2 pages).

* cited by examiner

[FIG. 1]
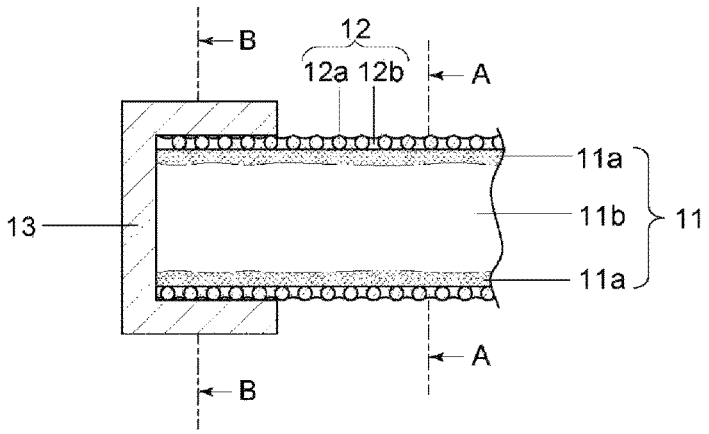
[FIG. 2]
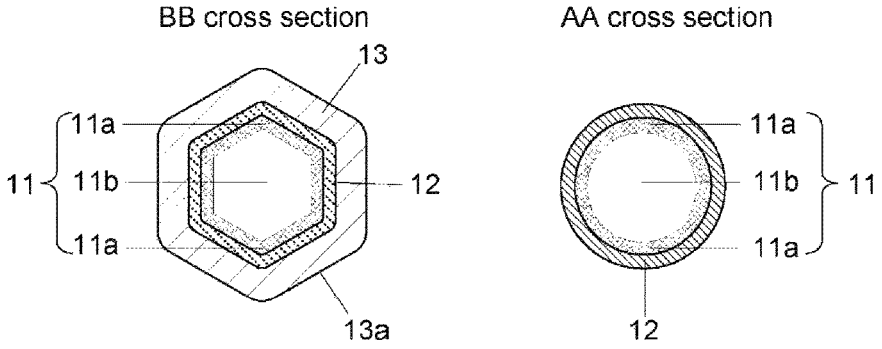

[FIG. 3A]
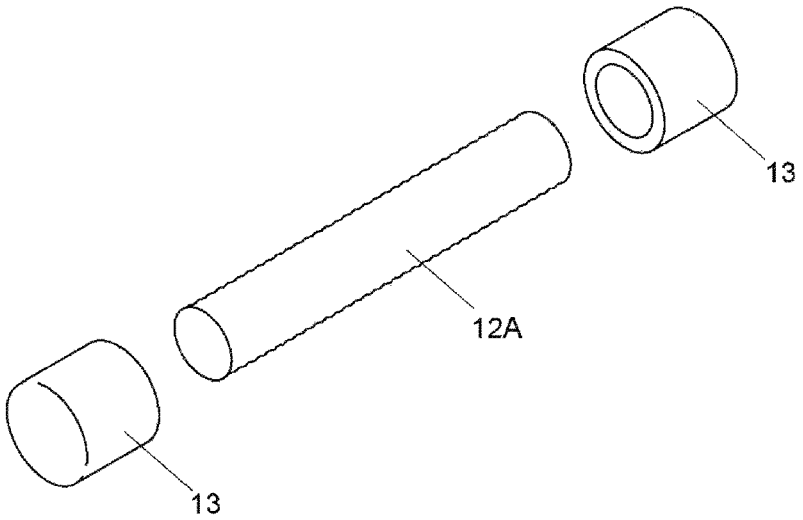
[FIG. 3B]
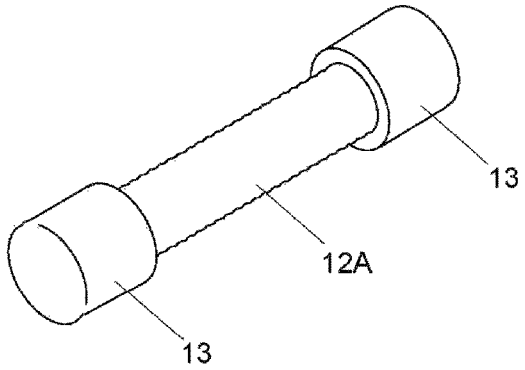

[FIG. 4]
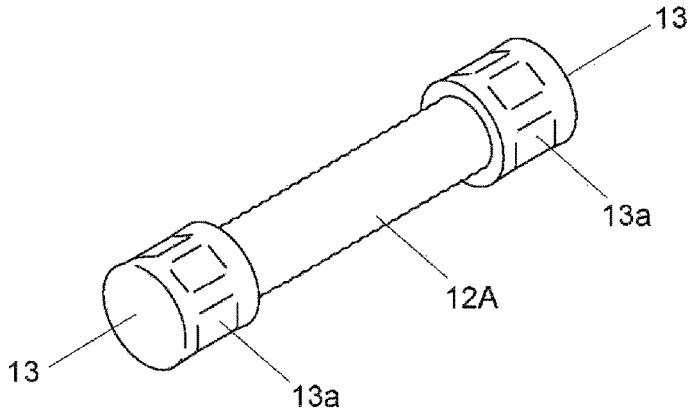
[FIG. 5A]
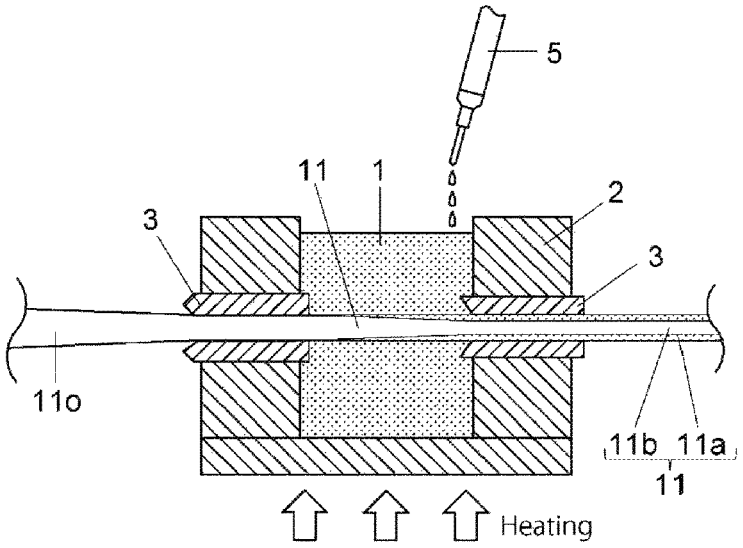

[FIG. 5B]
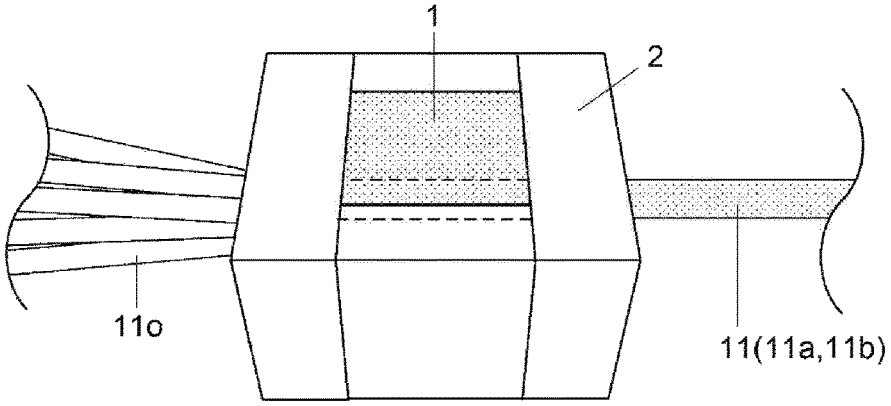
[FIG. 6]
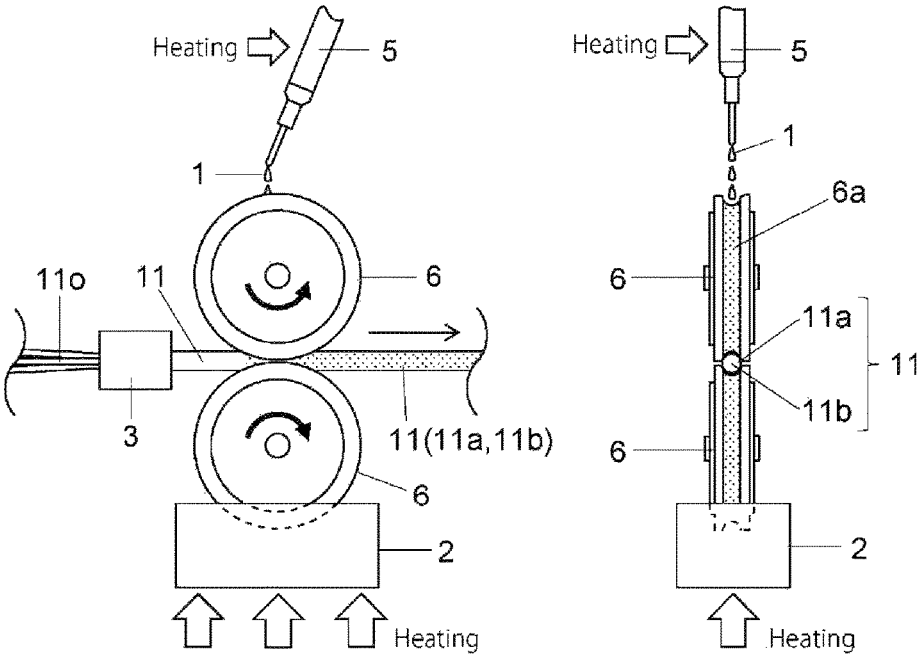

[FIG. 7A]
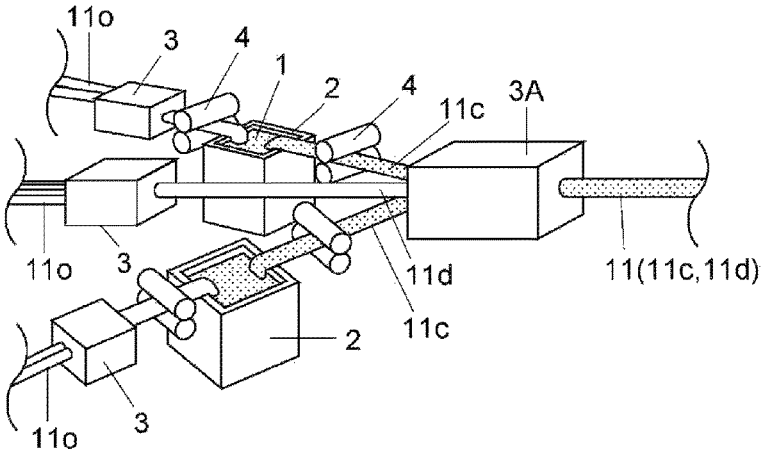
[FIG. 7B]
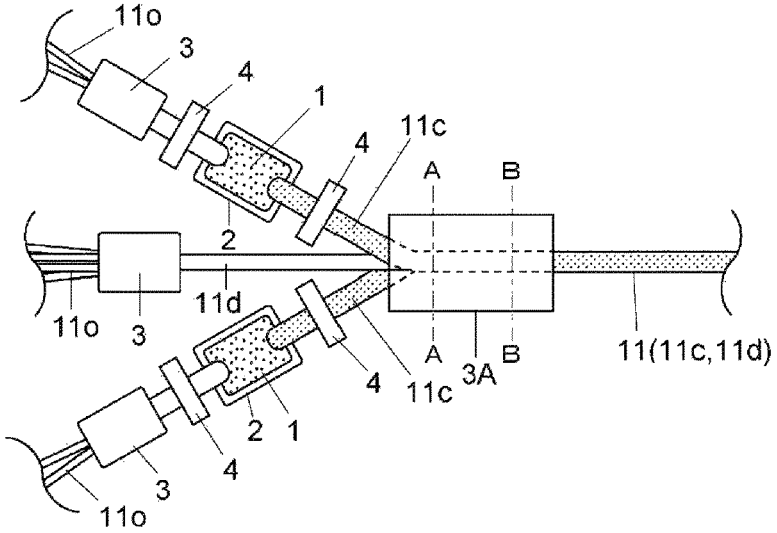

[FIG. 7C]
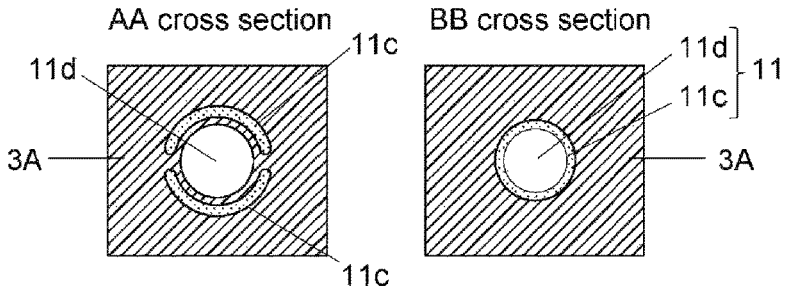
[FIG. 8]
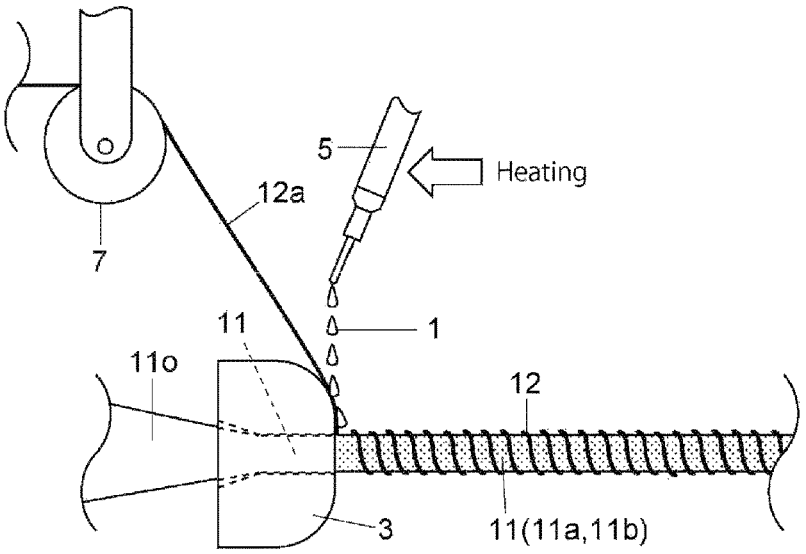

WIRE-WOUND RESISTOR AND METHOD FOR MANUFACTURING SAME

TECHNICAL FIELD

The present invention relates to resistors, particularly relating to wire-wound resistors in which a resistor wire is wound onto a core obtained by bundling fibrous insulators and a method for manufacturing the same.

BACKGROUND ART

The wire-wound resistors had been known from the past. Japanese laid open patent publication S59-115501 discloses wire-wound resistors in which a resistor wire is wound onto an external periphery of a core obtained by bundling glass fibrous insulators. That is, wire-wound resistors in which a resistor wire such as a carbon fiber is continuously wound onto a core formed by bundling a lot of glass fibrous insulators and impregnating with a heatproof binder such as silicon varnishes had been disclosed.

Japanese laid open patent publication H9-320804 discloses wire-wound resistors in which a resistor wire is wound onto a core obtained by bundling glass fibrous insulators, a connection terminal is attached to both ends of the resistor element, and the resistor element is accommodated in a ceramics case and fixed by cement material. In the resistor element, connection terminals are attached by caulking at both ends of the resistor element after winding a resistor wire on the core and cutting to a prescribed length.

The wire wound resistors can be used for a filter element (noise prevention resistor) because of having high inductance component other than resistance component. The resistors have been used, for example, for effectively suppressing radiation of high frequency noises, which is generated, for an example, when a motor vehicle is ignited. Further, the wire-wound resistor can be used for a heat-resistant resistor element by accommodated into a ceramic case.

SUMMARY OF INVENTION

Technical Problem

The wire-wound resistor is manufactured by winding a resistor wire onto a external periphery of a core formed by bundling fibrous insulators, cutting into a prescribed size, attaching a connection terminal such as a cap at both ends of the element, and caulking the connection terminals from outer to center direction. In the conventional technology, all over the core is impregnated with a binder for securing compressive strength and bent strength, and for maintaining a shape of the bundle of the glass fibrous insulators when transporting. That is, all over the core consisting of the bundle of fibrous insulators has been hardened by the binder, by using a capillary action, so as to spread the binder to all over the core.

However, according to the conventional technology, when caulking the connection terminals from outer to center direction, the core can not endure the transforming stress by the caulking and there are cases that cracks are generated in the core. Further, the connection terminal such as a metal cap and the core in which the binder (resin material) is impregnated are different in thermal expansion coefficient. Thus, in high temperature the core expands largely than the connection terminal to expand inner size of the connection terminal. Returning back to normal temperature, the connection terminal shrinks, but it can not return back to original size. Then space between the core and the connection terminal is generated to make the conductivity between the wire and the connection terminal deteriorated.

The invention has been made basing on above-mentioned circumstances. Thus an object of the invention is to provide a wire-wound resistor and method for manufacturing the same, which has high stability and high reliability of conduction.

Solution to Problem

The wire-wound resistor of the present invention is a resistor in which a resistor wire is wound onto an external periphery of a core obtained by bundling fibrous insulators, and a connection terminal is attached to both ends of the core and connected to the resistor wire, wherein the core is impregnated with a binder in the portion in the vicinity of the external periphery. The core is impregnated with the binder only in the portion in the vicinity of the external periphery and the binder is preferably not included in a center portion.

The method for manufacturing the wire-wound resistor comprises forming a long length core obtained by bundling fibrous insulators; winding a resistor wire onto an external periphery of the core; forming a resistor element by cutting the core into a prescribed size; and attaching a connection terminal at both ends of the resistor element; wherein a binder is impregnated in a portion in the vicinity of the external periphery of the core.

According to the present invention, the core is impregnated with the binder only in the portion in the vicinity of the external periphery and the binder is preferably not included in a center portion. Thereby, the whole core obtained by bundling fibrous insulators does not harden, and a center portion obtained from fibrous insulators plays the role as a cushion. Thus, the core has flexibility as a whole. As a result, the stress, which is caused by when caulking the connection terminals or influence of thermal expansion caused by temperature change in the environment, can be reduced according to the cushion action. Therefore, the resistor can be prevented from generation of cracks or conduction defects between the wire and the connection terminal, and the resistor can be provided with high stability and high reliability of conduction.

BRIEF DESCRIPTION OF DRAWINGS

FIG. 1 is a partial cross-sectional view of the wire-wound resistor of an embodiment of the present invention along a long length direction of the resistor.

FIG. 2 is a cross-sectional view of the wire-wound resistor of an embodiment of the present invention. Left view shows BB cross-section in FIG. 1, and right view shows AA cross-section in FIG. 1.

FIG. 3A is an exploded perspective view of the resistor element before attaching the connection terminals to both ends of the resistor element.

FIG. 3B is an exploded perspective view of the resistor element after attaching the connection terminals to both ends of the resistor element.

FIG. 4 is a perspective view of the resistor element after caulking the connection terminals.

FIG. 5A is a cross-sectional view, which shows an essential part of method for impregnating a binder into the core according to first embodiment.

FIG. 5B is a perspective view of above FIG. 5A.

FIG. 6 is views, which shows an essential part of method for impregnating a binder into the core according to second embodiment. Left view is a front view, and right view is a side view.

FIG. 7A is a view, which shows an essential part of method for impregnating a binder according to third embodiment.

FIG. 7B is a plan view of FIG. 7A.

FIG. 7C is cross-sectional views of AA cross section and BB cross section in FIG. 7B.

FIG. 8 is a front view, which shows an essential part of method for impregnating a binder according to fourth embodiment.

DESCRIPTION OF EMBODIMENTS

Embodiments of the present invention will be described below with referring to FIG. 1 through FIG. 8. Like or corresponding parts or elements will be denoted and explained by same reference characters throughout views.

FIG. 1 and FIG. 2 show cross sections of an essential part of the wire-wound resistor of the present invention. The wire-wound resistor in which a resistor wire 12*a* of prescribed resistance is wound onto an external periphery of a core 11 obtained by bundling fibrous insulators, and a connection terminal 13 such as metal cap is attached to both ends of the core 11 and connected to the resistor wire 12*a*. The core 11 is obtained by bundling a lot of fibrous insulators such as glass, ferrite, resin, and alumina, etc.

The core 11 is impregnated with a binder in the portion 11*a* in the vicinity of the external periphery. That is, as shown in FIG. 1 and FIG. 2, the portion 11*a* in the vicinity of the external periphery (where the binder is impregnated) surrounds the center portion 11*b* of the core 11, where the binder is not much impregnated or the binder is not at all impregnated. The portion 11*a* in the vicinity of the external periphery, where the binder is impregnated, need not be uniformly formed along the external periphery of the core 11. The center portion 11*b* of the core 11 is allowable to be impregnated with the binder not so much. However, the center portion 11*b* of the core 11 is most preferable that the binder is not impregnated at all.

Here, the binder consists of an epoxy system resin etc. of a low viscosity. The binder enters into a bundle of fibrous insulators by the capillary action. After the portion 11*a* in the vicinity of the external periphery is impregnated with the binder, a heat is applied for hardening, then solidified binder layer (portion 11*a*) is formed.

For example, a bundle of fibrous insulators consists of a bundle of very thin fibers, where the fiber diameter is from several μm to ten several μm. Therefore, the bundle of fibrous insulators without a binder cannot be maintained to keep its shape, when transporting the long bundle in the manufacture process. Thus, by impregnating a binder consisting of low viscosity resin to the bundle and heating to harden the binder, the shape of the bundle of fibrous insulators can be maintained.

It is necessary that the core contains 5%~70% of the binder impregnated portion in cross section. If the binder impregnated portion is 5% or less, it becomes difficult to maintain the shape of the core consisting of a bundle of fibrous insulators. If the binder impregnated portion is 70% or more, the cushion effect of the core becomes weak as mentioned later.

The portion, where the binder is included, is preferable to be smaller. Since it is important so as to reduce the portion where the fibrous insulators are hardened. It is preferable that binder included portion is 10~30% of the core in cross section, and binder not included portion (fibrous insulators as it is) is 70~90% of the core in cross section. Thereby, the core 11, which excellently balances the shape maintaining layer of binder included portion in the vicinity of the external periphery of the core and the cushion layer of binder not included portion in the center portion of the core, can be obtained.

It is preferable that the core 11 is not impregnated with the binder at the center portion 11*b* along its all of the length. However, it can be used for improving compression strength and bent strength while keeping cushion effect that the core 11 is not impregnated with the binder at the center portion 11*b* at the part to be accommodated in the connection terminal, and that the core 11 is impregnated with the binder at the center portion 11*b* at the part other than to be accommodated in the connection terminal.

The resistor wire 12*a* is wound onto the external periphery of the core 11, and the resistor wire 12*a* is fixed to the external periphery of the core 11 by the resin 12*b* to form the winding layer 12 (see FIG. 1). The Ni wire, the NiCr wire, the NiFe wire, and the CuNi wire, etc. are used as the resistor wire 12*a*.

The connection terminals 13 such as a cap etc. are attached and fixed at both ends of the resistor element and almost flat caulking result 13*a* is formed by caulking process, which apply pressure from outer to center (see FIG. 4). When caulking, since the binder is not included in the center portion 11*b* of the core 11, and the bundle of fibrous insulators plays the roll of a cushion, it is not necessary to form deep caulking result biting to inside. Therefore, the caulking result 13*a* is flat, not biting to inside, and it is preferable that the connected terminal 13 forms a polygon. Accordingly, the cross section of core 11 at caulking portion of the connection terminal 13 becomes a polygon (see FIG. 2 Left view).

Since the core 11 is impregnated with the binder in the portion in the vicinity of the external periphery and the binder is not included in the center portion of the core 11, the core 11 is provided with the elasticity. That is, the stress from outer direction when caulking the connection terminal 13 is absorbed by the cushion effect of the center portion 11*b* of the core 11 where the binder is not included in the fibrous insulators, then cracking is hard to occur in the core 11.

Further, since the core is impregnated with the binder in the portion in the vicinity of the external periphery, then binder impregnated portion is small, and thermal expansion can be suppressed in high temperature environment, thus expanding inner diameter of connection terminal 13 according to thermal expansion can be prevented. Then returning back to room temperature, space is hard to occur between the connection terminal 13 and the wire 12*a*, thus it enables to keep good conduction state between the connection terminal 13 and the wire 12*a* longer than prior art technology, thus improving stability of conduction, that is, reliability of conduction can be improved.

Next, method for manufacturing the wire-wound resistor will be described as follows. The wire-wound resistor is manufactured by forming a long length core obtained by bundling fibrous insulators; winding a resistor wire 12*a* onto an external periphery of the core; forming a resistor element 12A by cutting the core into a prescribed size; and attaching a connection terminal at both ends of the resistor element 12A (see FIG. 3A-3B).

As the fibers for the core 11, a bundle of fibers such as the glass, the ferrite, the resin, and the alumina can be used.

When heatproof characteristics is required, it is preferable to use the glass fiber or the alumina fiber.

The method for obtaining the core 11 comprises impregnating a binder (low viscosity liquid phase epoxy resin etc.) in a portion 11*a* in the vicinity of the external periphery of long length core such as a bundle of glass fibers; applying a heat for hardening the binder to be a solid phase resin layer; and forming a long length core consisting of glass fibers etc., which does not at all or not much include the resin layer at center portion thereof.

FIG. 5A-FIG. 5B show a binder impregnation method of first embodiment. Liquid phase resin 1 such as epoxy (preferably solvent not included) etc., in which viscosity is controlled to be low by temperature control, is stored in a metal tank 2. By the core 11 consisting of a bundle of glass fibers passing through the tank 2, the resin is impregnated into a portion in the vicinity of the external periphery (surface) of the core.

Glass fibers 11*o* of raw material is bundled by the squeezing nozzle 3 installed at the entrance of tank 2, and bundled glass fibers 11*o*, that is, core 11 enters into the tank 2, where the impregnation depth is controlled by the impregnation time so that the resin must not reach to the central portion 11*b* of the core 11.

As an example, the core 11 that is a bundle of the glass fibers of about 3.6 mm in outer diameter is formed by passing through the squeezing nozzle 3. The transportation speed of the core 11 is various depending on pitch of the winding etc. However, impregnation time of resin into core 11 from entering into tank 2 to going out of tank 2 is preferably 5 seconds or less.

If impregnation time is 5 seconds or more, the resin will be impregnated all over the core, or the difference will be caused in the impregnation depth. Thus, the impregnation time 2-4 seconds is most desirable. Accordingly, the core 11 is impregnated with the binder in the portion 11*a* in the vicinity of the external periphery, and the binder is not included in the center portion 11*b* of the core 11.

Temperature control for the binder (resin) in the tank 2 is carried out by heating the tank 2 with a heater etc. When an amount of the binder decreases in the tank 2, an amount of the binder is supplied from upper open space of the tank 2 with dispenser 5 etc. (see FIG. 5A). Then, the binder (resin) of a constant amount is always filled in the tank 2. Further, the change of the amount of the binder (resin) in tank 2 is detected with a sensor etc. (not shown in the figure).

The method is characterized in that a lot of glass fibers 11*o* is bundled by the squeezing nozzle 3, and bundled glass fibers 11*o*, that is, core 11 enters into the tank 2, and pass through the tank 2 in short time. The resin such as epoxies doesn't contain the solvent, and be adjusted to a suitable temperature and the viscosity. The method is the easiest in the temperature and the viscosity management of the resin, and all over the circumference of the core 11 uniformly touches the resin. Therefore, the method makes it possible that all over the circumference of the core 11 is impregnated with the binder in the portion 11*a* in the vicinity of the external periphery and the binder is not included in the center portion 11*b* of the core 11.

And, molding a long length core 11 process finishes by applying a heat for hardening the binder to be a solid phase resin layer. Accordingly, the core 11, which has the binder included portion 11*a* in the vicinity of the external periphery of the core and the binder not included portion 11*b* in the center portion of the core, can be provided with the the cushion layer consisting of the bundle of glass fibers inside of the core 11.

That is, according to the binder included portion 11*a* in the vicinity of the external periphery of the core 11, the resistor of the present invention can ensure compression strength and bent strength of the product and preventing from deformation of the core in the manufacturing process. And, according to the cushion layer in the center portion 11*b* of the core 11, generation of cracking in the core 11 is hard to occur, and generation of space depending on temperature change between the connection terminal 13 and the wire 12*a*, is hard to occur, thus connection failure can be prevented. Thus, high reliability wire-wound resistor can be produced.

FIG. 6 shows a binder impregnation method of second embodiment. Glass fibers 110 of raw material is bundled by the squeezing nozzle 3. Bundled glass fibers 11*o*, that is, to be core 11, enters into the rotary roller 6, which is provided with a pair of rollers 6 for feeding the core 11 by sandwiching the core 11 between the pair of rollers 6, while the core 11 being impregnated with the binder 1. The roller 6 has a groove 6*a*, into which the binder (resin) 1 is poured (see FIG. 6 Right View).

Dispenser 5 etc. pours the liquid phase resin 1 into the groove 6*a*, and the roller 6 forms an impregnated layer with resin 1 in the portion 11*a* in the vicinity of the external periphery of the core 11. That is, by transferring a binder onto a surface of the core 11, which consists of a bundle of glass fibers, the core 11 is impregnated with a binder in the portion 11*a* in the vicinity of the external periphery.

The temperature and the viscosity of the resin 1 are adjusted beforehand as well as first embodiment, so that resin 1 is prevented from impregnating into the inside (center portion) of the core 11. Accordingly, the portion 11*b* that consists only of the glass fibers that doesn't contain the resin is formed at inside (center portion) of the core 11. According to the method, impregnating time is short comparing to first embodiment, the method makes it possible that the resin 1 can be impregnated shallowly only in the vicinity of the external periphery of the core 11. However, amount of impregnation of the resin can be controlled by amount of spreading (amount of exhalation) of dispenser 5, amount of resin in the tank 2, pressing force to glass fiber by roller 6 etc.

FIG. 7A-FIG. 7C shows a binder impregnation method of third embodiment. The method is an application of the method of the first embodiment. A first part of glass fibers 11*o*, which is a raw material for outer portion of core 11, is molded by squeezing nozzle 3 and roller 4 to plate-shaped fibers. The plate-shaped fibers are immersed in a tank 2, where liquid phase resin 1 is stored, then all over the plate-shaped fibers is impregnated with resin 1 to be resin included core 11*c* (see FIG. 7A). A second part of glass fibers 11*o*, which is a raw material for inner portion of core 11, is molded by squeezing nozzle 3 to circular-shaped core 11*d*, which does not include resin. Core 11*c*, core 11*d* and core 11*c* are fed while sandwiching core 11*d* between core 11*c* and core 11*c* to the throttle nozzle 3A.

Plate-shaped core 11*c* with resin, circular-shaped core 11*d* without resin and plate-shaped core 11*c* with resin are fed to the throttle nozzle 3A so as to bundle them. When bundling them at the throttle nozzle 3A, a pair of plate-shaped core 11*c* surrounds the circular shaped core 11*d* (see FIG. 3B-FIG. 3C). Thereby, at the circumference of core 11*d* (without resin), a pair of core 11*c* (with resin) is formed so as to surround the core 11*d* like a ring.

Third embodiment is characterized in that feeding two bundles of glass fibers with resin and a bundle of glass fibers without resin separately, and when combining, a bundle of glass fibers without resin (inside) is surrounded by two bundles of the glass fibers with resin (outside). According to the method, by only controlling an amount of glass fibers with resin, it becomes easy to control thickness of the layer impregnated with the resin.

In first to third embodiments, a resistor wire 12*a* is wound onto an external periphery of the core 11, which is impregnated with resin in the portion 11*a* (11*c*) in the vicinity of the external periphery, and the resistor wire 12*a* is fixed onto an external periphery of the core 11 by the resin 12*b* to form a resistor wire wounded layer 12. As the resistor wire 12*a*, the Ni wire, the NiCr wire, the NiFe wire, and the CuNi wire, etc. are used. (see FIG. 1)

FIG. 8 shows a binder impregnation method of fourth embodiment. The method is to impregnate the binder in the portion 11*a* in the vicinity of the external periphery of the core 11, at the same time with a resistor wire wiring onto the external periphery of the core 11. Liquid phase resin 1, which is dropped from dispenser 5 etc., ran down out face of wire-winding nozzle (device for bundling glass fibers) 3, which determines final size (diameter) of the core in wire-winding process, supplied to core (a bundle of glass fibers) 11 and impregnated in the portion 11*a* in the vicinity of the external periphery of the core 11.

In the case, time of contact between resin 1 and core 11 becomes very short, then the resin 1 is hard to impregnate into inside of the core. According to the method, different from other methods, the resin can be impregnated in small area with shallow depth on a surface or in the portion in the vicinity of the external periphery of the core 11. Also, an amount of resin impregnated into the core can be controlled by discharge rate of the dispenser 5. According to the method, resin coating process after resistor wire winding process can double as binder impregnation process, total number of processes can be reduced. The other hand, it is possible to supply the resin directly on the core 11 from upper and lower sides or left and right sides by using bristles or brushes.

As described above, by impregnating a binder in the portion in the vicinity of the external periphery of the core 11, and winding a resistor wire 12*a* onto an external periphery of the core 11, a long-length core having a wire-winding layer 12, which is fixed by resin 12*b*, is obtained. Next, the long length core is cut into a predetermined length to form resistor elements 12A. And, connection terminals 13 such as a cap etc. are attached at both ends of the resistor element 12A (see FIG. 3A-FIG. 3B).

Next, pressure is applied to connection terminals 13 from outer to center direction by caulking process to form almost flat caulking result 13*a* (see FIG. 4). At the moment, the bundle of fibers in the center portion 11*b* plays the roll of the cushion, then it is not necessary to make the caulking result 13*a* biting into inside deeply. Thereby, it is preferable that the caulking result 13*a* is flat and does not bite to inside, and the connection terminal forms a polygon (see FIG. 2 Left view).

According to the wire-wound resistor manufactured by above method, the core 11 consisting a bundle of glass fibers etc. is impregnated with the binder only in the portion 11*a* in the vicinity of the external periphery and the binder is not much impregnated or not at all impregnated in the center portion 11*b*. Thus, the whole core 11 does not harden, and the core 11 has flexibility as a whole.

As a result, in the manufacturing process, the core 11 consisting of a bundle of glass fibers can keep its shape. And, a center portion 11*b*, where the binder is not much impregnated or not at all impregnated, plays the role as a cushion. Therefore, the resistor can be prevented from generation of crack or conduction defects between the wire and the connection terminal, thus the resistor can be provided with high stability and high reliability.

Although embodiments of the present invention have been explained, however the invention is not limited to above embodiments, and various changes and modifications may be made within scope of the technical concepts of the invention.

INDUSTRIAL APPLICABILITY

The present invention can be suitably used for wire-wound resistors, in which a resistor wire is wound onto an external periphery of a core obtained by bundling fibrous insulators, and method thereof.

The invention claimed is:

1. A wire-wound resistor in which a resistor wire is wound onto an external periphery of a core obtained by bundling fibrous insulators, and a connection terminal is attached to both ends of the core and connected to the resistor wire, wherein the core is impregnated with a binder in the portion in the vicinity of the external periphery, and wherein the core is impregnated with the binder in 5%-70% portion of the core in the cross section.

2. The wire-wound resistor of claim 1, wherein the binder is not included in a center portion of the core.

3. The wire-wound resistor of claim 1, wherein the binder is not included in the center portion of the core accommodated in inside of the connection terminals.

4. The wire-wound resistor of claim 1, wherein a cross section of the core is a polygon at the caulking portion to the connection terminal, and the caulking result does not bite inside.

5. A method for manufacturing a wire-wound resistor comprising:

forming a long length core obtained by bundling fibrous insulators;

winding a resistor wire onto an external periphery of the core;

forming a resistor element by cutting the core into a prescribed size; and attaching a connection terminal at both ends of the resistor element;

wherein the core is impregnated with a binder in the portion in the vicinity of the external periphery, and wherein the core is impregnated with the binder in 5%-70% portion of the core in the cross section.

6. The method of claim 5, wherein the core is impregnated with a binder in the portion in the vicinity of the external periphery, and the binder is not included in a center portion of the core.

7. The method of claim 5, wherein by the core, which bundles fibrous insulators, passing through in a tank, which stores the binder, the core is impregnated with the binder in the portion in the vicinity of the external periphery.

8. The method of claim 7, wherein a time of the core passing through in the tank, which stores the binder, is five seconds or less and two seconds or more.

9. The method of claim 5, wherein by a roller transferring the binder onto the core, which bundles fibrous insulators, the core is impregnated with the binder in the portion in the vicinity of the external periphery.

10. The method of claim 9, wherein transferring the binder is carried out while the core is sandwiched between a pair of rollers in vertical direction.

11. The method of claim 5, further comprising:

immersing a first part of fibrous insulators in a tank, where a binder is stored, so that the first part of fibrous insulators is impregnated with the binder;

bundling a second part of fibrous insulators without the binder; and bundling the first part of fibrous insulators with the binder so as to surround the second part of fibrous insulators without the binder.

12. The method of claim 11, wherein the fibrous insulators without the binder are folded in by the fibrous insulators with the binder.

13. The method of claim 5, wherein the binder ran down out face of a wire-winding nozzle, and supplied to the core consisting of a bundle of fibrous insulators, and the core is impregnated with the binder in the portion in the vicinity of the external periphery.

* * * * *